US005253508A

United States Patent [19]

Bakermans

[11] Patent Number: 5,253,508

[45] Date of Patent: Oct. 19, 1993

[54] FORCE TRANSMITTING COUPLING FOR STAMPING AND FORMING MACHINE

[75] Inventor: Johannes C. W. Bakermans, Harrisburg, Pa.

[73] Assignee: Whitaker Corporation, Wilmington, Del.

[21] Appl. No.: 929,255

[22] Filed: Aug. 12, 1992

[51] Int. Cl.[5] ..... B21J 13/04; B21J 9/18

[52] U.S. Cl. ..... 72/431; 72/450; 72/402; 72/452; 83/622; 83/628; 100/280

[58] Field of Search ..... 83/602, 620, 622, 628; 100/280, 281, 282; 72/402, 450, 452, 431

[56] References Cited

U.S. PATENT DOCUMENTS

| | | | |
|---|---|---|---|
| 3,602,078 | 8/1971 | Schindler | 83/622 |
| 3,886,829 | 6/1975 | Criblez | 83/628 |
| 4,195,564 | 4/1980 | Shiokawa | 83/628 |
| 4,497,196 | 2/1985 | Bakermans et al. | 72/405 |
| 4,819,476 | 4/1989 | Bakermans et al. | 72/450 |
| 4,934,173 | 6/1990 | Bakermans et al. | 72/450 |

*Primary Examiner*—David Jones

[57] ABSTRACT

Force transmitting coupling (44) for transmitting force from an actuator (16) which oscillates along an arcuate path to a ram block (12) which reciprocates along a rectilinear path comprises a flexible member (50) coupling which is connected to the actuator (16) by a lost motion connection (90, 94) and which is against the ram block (12). The flexible member (50) is supported intermediate its ends in a manner such that it can flex by a predetermined amount but not more than the predetermined amount. When the ram block (12) is pushed from a retracted position to a forward position, the flexible member is placed in compression and flexes by only the predetermined amount. The force transmitted to the ram block is applied to the axis of the ram block.

20 Claims, 6 Drawing Sheets

FORCE TRANSMITTING COUPLING FOR STAMPING AND FORMING MACHINE

FIELD OF THE INVENTION

This invention relates to force transmitting couplings and particularly to couplings between a ram assembly which reciprocates along a rectilinear path and an actuator which oscillates along an arcuate path.

BACKGROUND OF THE INVENTION

U.S. Pat. No. 4,497,196 describes a stamping and forming machine having aligned opposed ram assemblies which move towards and away from each other along rectilinear paths. The ram assemblies have stamping and forming tooling on their opposed faces which performs stamping and forming operations on strip material which is fed along a strip feed path that extends between the ram assemblies. The ram assemblies are reciprocated by levers which oscillate along arcuate paths and which are coupled to the ram assemblies. The couplings must be such that they are capable of accommodating the arcuate movement of the levers and transmitting forces from the levers to the ram assemblies as they reciprocate along their straight line paths. The above identified U.S. Patent describes a machine in which universal joints are used in the couplings and good service has been obtained with universal joints although they tend to wear out with time and with prolonged usage because of the friction generated or developed during operation of the machine. Application Ser. No. 915,79 filed Jul. 16, 1992 (15343) describes an improved coupling which has cylindrical bearing surfaces with the axes of the cylindrical surfaces extending normally of the path of reciprocation of the ram assembly and normally of the plane of oscillation of the actuator lever. Couplings of the type shown in that application are an improvement over universal joint type couplings for the reason that the friction is greatly reduced and longer life in the coupling is obtained.

The present invention is directed oo the achievement of an improved force transmitting coupling which applies force transmitted from an arcuately moving actuator to the axis of a ram which reciprocates along a rectilinear path. The invention is further directed to the achievement of a coupling which is essentially frictionless so that the necessity for lubricating the coupling is avoided and to the achievement of a "fail safe" coupling.

THE INVENTION

The invention comprises force transmitting means or transmitting force from an actuator assembly, which moves to-and-fro along an actuator path, to a ram assembly which reciprocates along a rectilinear path between a retracted position and a forward position. The force transmitting mean comprises a flexible member which extends between the actuator assembly and the ram assembly and which has first and second ends. The first end of the flexible member is against the ram assembly and the second end is proximate the actuator assembly. The flexible member and the ram assembly are connected to each other by oppositely facing shoulder portions on the ram and flexible member. The flexible member and the actuator assembly are connected to each other by a lost motion connection. The actuator assembly has actuator driving surface portions which are adjacent to, and movable against, the second end of the flexible member. Supporting surfaces are provided which extend parallel to the flexible member. These supporting surfaces permit a limited amount of flexure in the flexible member and prevent flexure by an amount greater than the limited amount. During operation, the ram assembly is pushed from its retracted position to its forward position by the actuator driving surface portions and the ram assembly is pulled from its forward position to its retracted position by the actuator acting through the opposed shoulder portions and the lost motion connection. When the ram is pushed from its retracted position to its forward position, the flexible member is placed under compression and flexes by the amount permitted by the supporting surfaces. When the ram assembly is pulled back to its retracted position, the flexible member functions as a tensioned member.

THE DRAWING FIGURES

THE DISCLOSED EMBODIMENT

Figure 1:
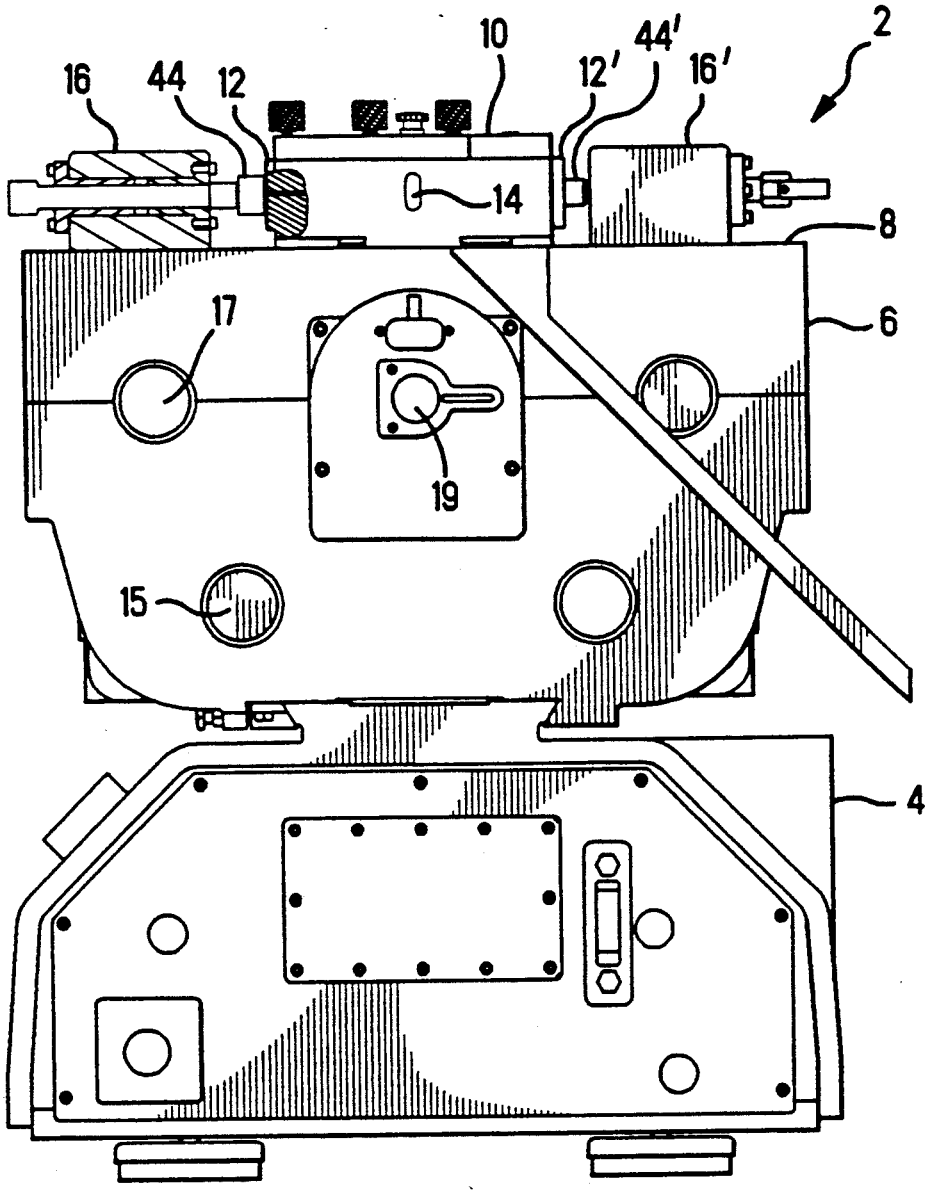
FIG. 1 is an end view of a stamping and forming machine.

A machine 2 of the type described in U.S. Pat. No. 4,497,196 has a base portion 4 on which one or more machine modules 6 are supported. The machine module has an upper surface 8 on which a ram housing 10 is supported. Opposed ram assemblies 12, 12' are sideably contained in the housing 10 and strip material is fed along a strip feed path which extends through aligned slots 14 in the housing. When the ram assemblies 12, 12' move towards each other, tooling on the opposed ends of the rams perform punching and forming operations on the strip material.

The ram assemblies are reciprocated by levers which oscillate along arcuate paths. These levers have upper ends 16, 16' which are coupled by coupling assemblies 44, 44' to the ram assemblies. Each lever is pivoted at its lower end 15 and is connected by an eccentric 17 intermediate its ends to a power shaft 19.

The lever assemblies and the couplings are substantially identical and in the description which follows, only the lever assembly shown on the left in FIG. 1 will be described in detail.

An opening 18 extends through the upper end 16 of the lever from the left side 20 to the right side 22 thereof. This opening is counterbored on the right side as shown at 24 and a fixed sleeve 26 is contained in the bore. The sleeve 26 has a flange that is received in the counterbore and is secured to the lever by fasteners 28.

An adjustable sleeve 30 is received in the left hand portion of the bore and has a flange 32 on its end. Fasteners 34 extend through the flange and bear against the surface 20 of the lever. An adjusting rod 36 extends through the sleeves 26, 30 and has a reduced diameter right hand end 38. The left hand end 40 of the rod is enlarged and is non-circular so that it can be turned with a wrench.

Figure 2:
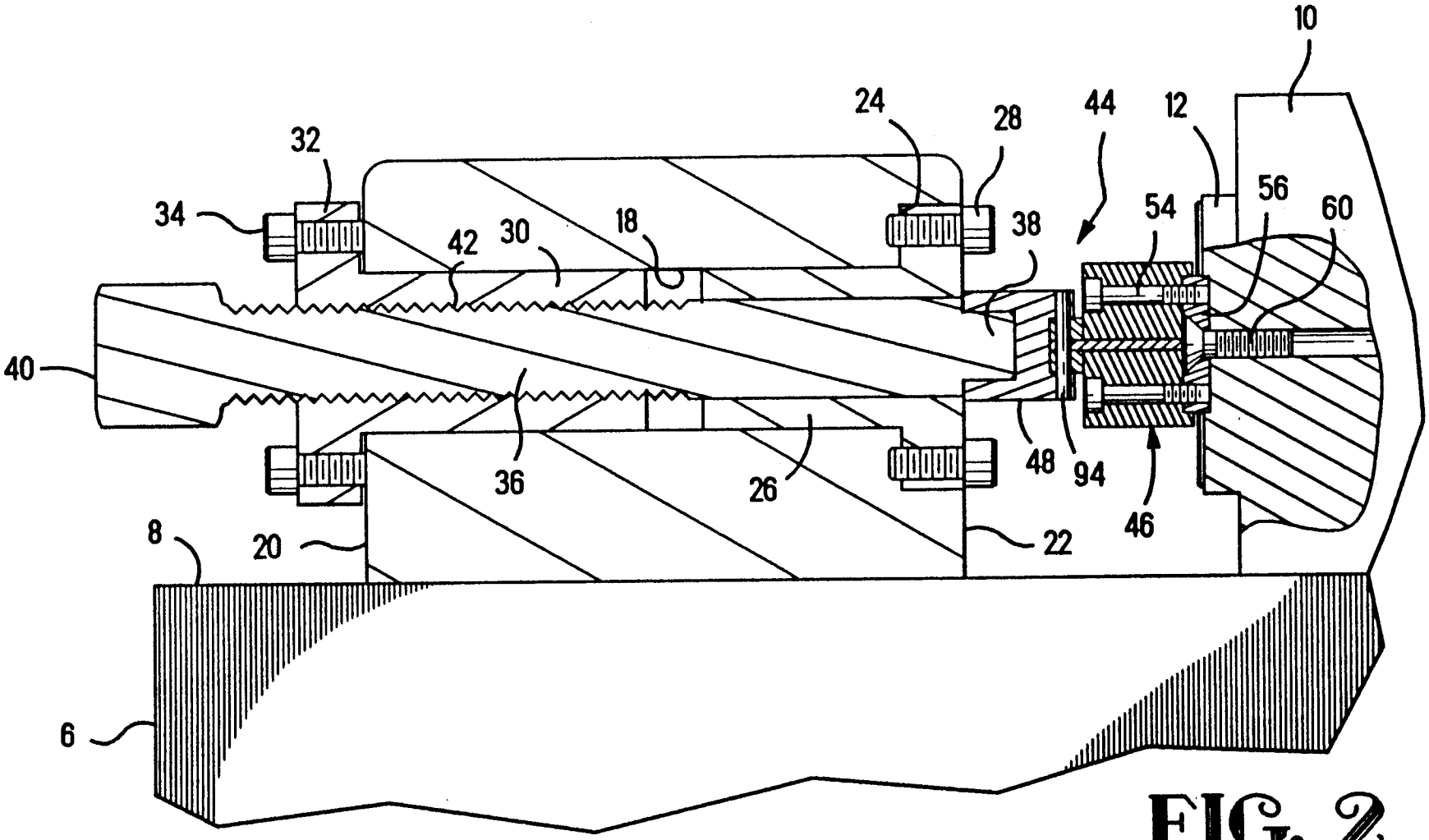
FIG. 2 is a sectional view, on an enlarged scale, of the upper portion of the actuator lever and the coupling between the actuator and the ram assemblies.

The external surface of the rod and the internal surface of the adjustable sleeve are provided with threads 42 so that the rod 36 can be adjusted rightwardly or leftwardly as viewed in FIG. 2 thereby to adjust the extreme positions of the ram assembly.

The coupling 44 which couples the upper end 16 of the lever to the ram assembly 12 will be described with reference to FIGS. 5–8. These Figures are diagramatic and do not show all of the parts in the actual embodiment of the coupling showing in FIGS. 2–4. The clearances between parts in FIGS. 5–8 are highly exaggerated for purposes of illustration and in some instances clearances are shown where they do not exist.

The coupling assembly 44 comprises first and second collar assemblies 46, 48 and a flexible plate-like member 50. The first collar assembly 46 is secured by fasteners 54 to an adaptor plate 56 which is received in a recess 58 in the ram assembly 12 and which is secured to the ram assembly by a screw 60. The ram assembly 12 is therefore secured rigidly to the first collar assembly 46. The adaptor is received in a recess 62 in the rightwardly facing surface 64 of the collar assembly 46.

Figure 6:
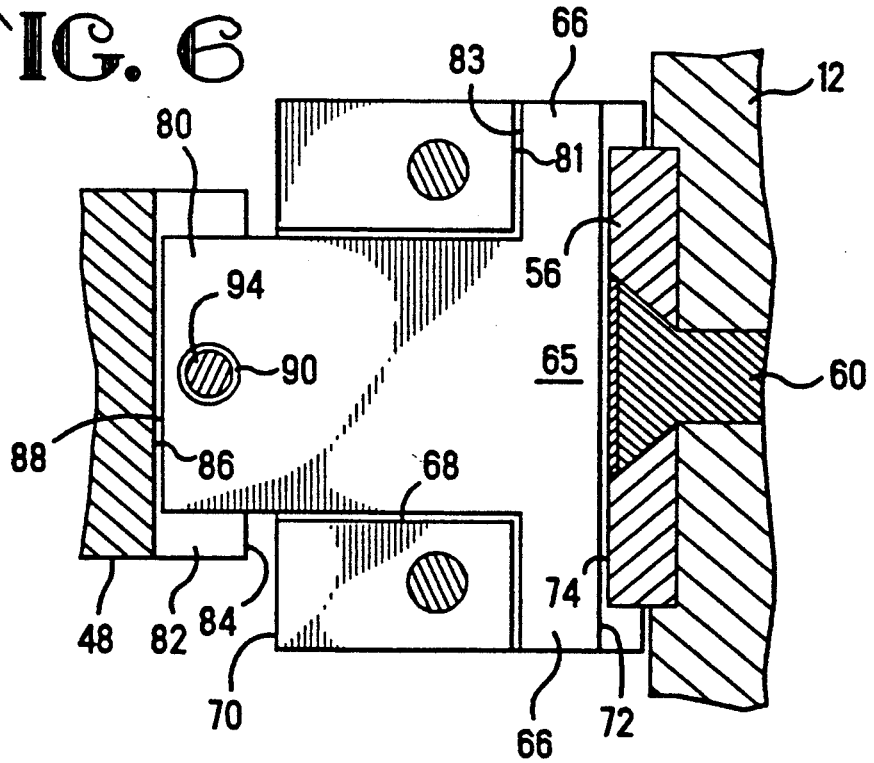
FIG. 6 is a diagramatic view looking in the direction of the arrows 6—6 of FIG. 5.

The flexible member 50 is a thin plate-like member having a substantial width as viewed in FIG. 6 relative to its thickness and has laterally extending arms 66 at its first end 65. A T-shaped recess 68 is provided in the collar assembly 46 and the flexible member 50 is contained in this recess. The right hand edge 72 of the first end 65 of the flexible member 50 is against the surface 74 of the adaptor 56 and the second end 80 of the flexible member extends beyond the left hand end 70 of collar assembly 46. The flexible member is supported, when it is in a flexed condition, by supporting surfaces 76, 78 in the collar assembly which extend parallel to the upper and lower surfaces of the flexible member 50. Adjacent to the first end 65 of the flexible member, these supporting surfaces converge as shown at 79 so that the first end of the flexible member 50 is more closely confined than the intermediate portion. The surfaces 76, 78 permit the flexible member to flex by a predetermined amount but prevent flexure by an amount greater than the predetermined amount.

The second end 80 of flexible member 50 extends into a recess 82 that extends inwardly in the second collar assembly 48. The inner end 86 of this recess is immediately adjacent to the trailing edge 88 of the flexible member. The surface 86 functions as a driving surface when the ram is pushed from its retracted position to its forward position. A hole 90 is provided in the flexible member and is in alignment with holes 92 in the collar assembly 48. A pin 94 extends through the hole 90 and is received in the holes 92 in the collar assembly. These holes and the pin 94 function as a lost motion connection between the flexible member and the collar assembly. The pin 94 is designed such that it functions as a shear pin so that in the event of the development of unduly high forces, the pin will shear and thereby prevent damage to the machine. The operation of the coupling 44 is as follows.

Figure 5:
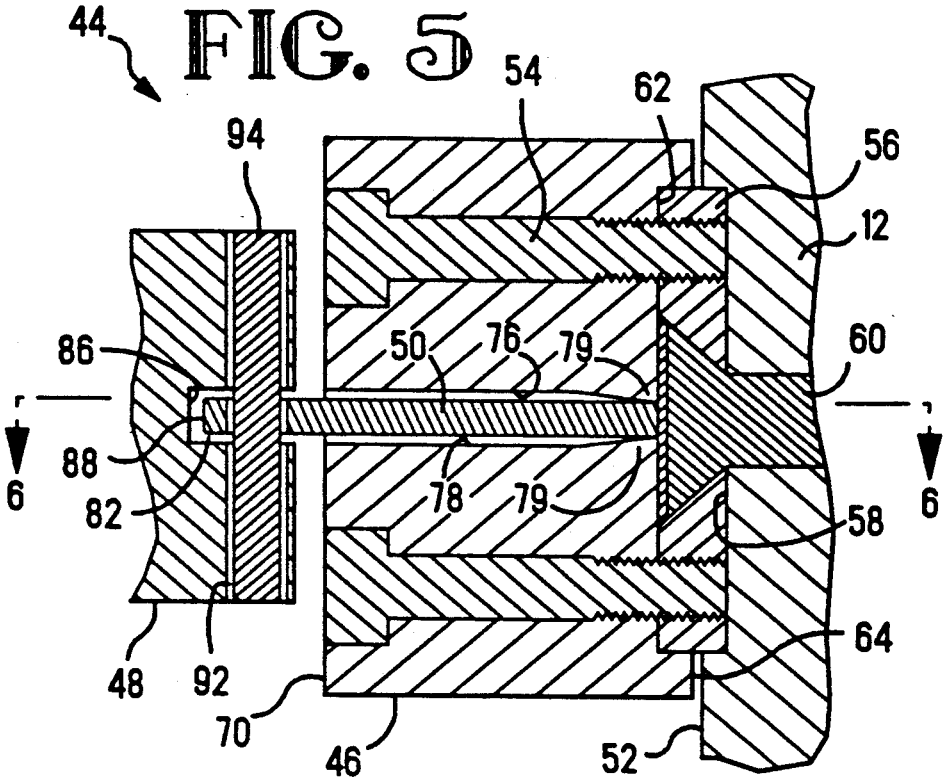
FIG. 5 is a simplified diagramatic side view of the coupling.
Figure 7:
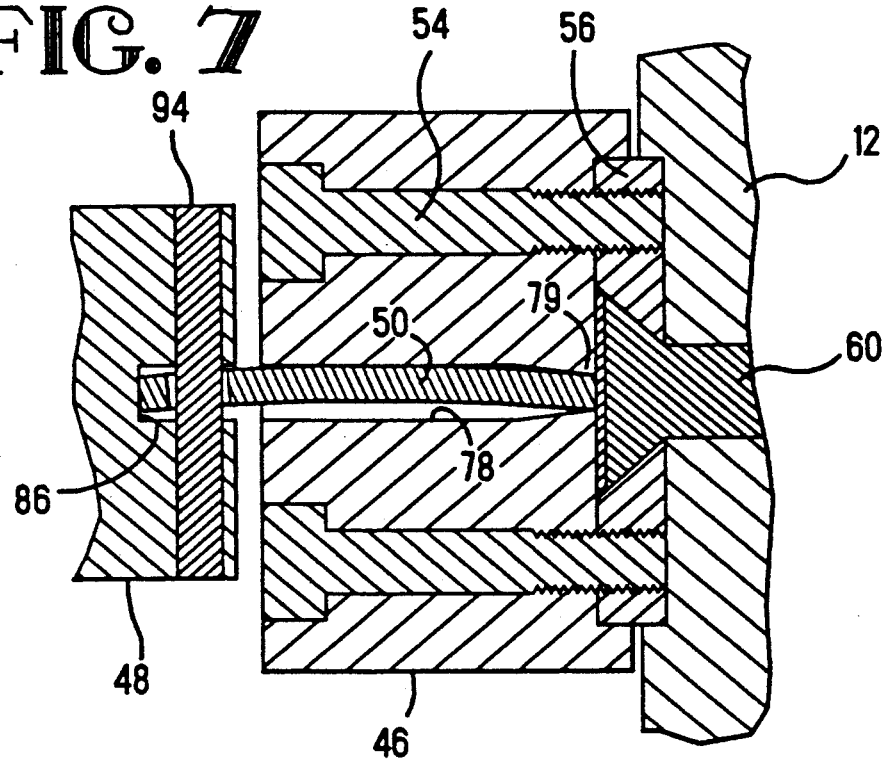
FIG. 7 is a view similar to FIG. 5 showing the positions of the parts when the ram assembly is being pushed from its retracted position to its forward position.

Assuming that the ram assembly 12 is in its retracted position and the actuator is at the leftward limit of its stroke as viewed in the drawing, the ram assembly is first pushed by the actuator rightwardly from the position showed in FIG. 5. The surface 86 of the collar assembly 48 moves against the edge 88 of the flexible member 50 and the flexible member in turn moves against the surface 74 of the adaptor 56. The flexible member flexes during this portion of the operating cycle as shown in FIG. 7 and the intermediate portion of the flexible member moves against, and is supported by, the surfaces 76, 78. Because of the fact that the intermediate portion of the flexible member is supported, it can function as a compression member notwithstanding its tendency to flex and its extreme thinness. During the forward stroke of the actuator 16, the flexible member will first flex in one direction toward one of the surfaces 76 or 78 and then towards the other surface. This reversal in the flexure of the member 50 is caused by the fact that the lateral force component transmitted from the actuator is upwardly, as viewed in FIG. 5, during one portion of the stroke and downwardly during the other portion. The constricted portions 79 of the supporting surfaces ensure that the leading or first end of the flexible member is closely confined and flexure will take place in a predictable manner.

Figure 8:
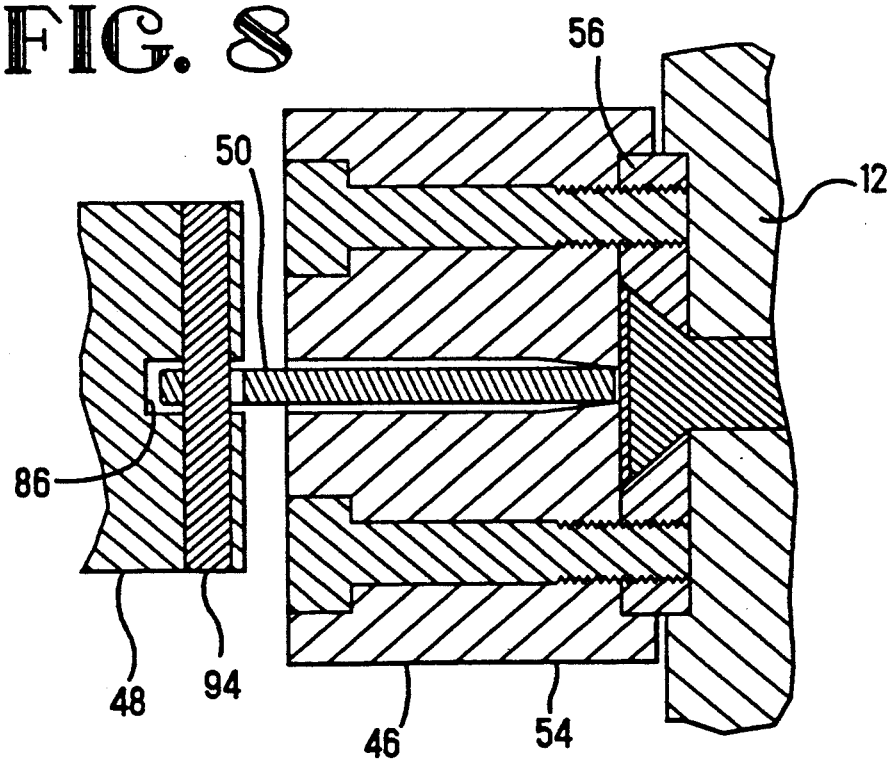
FIG. 8 is a view similar to FIG. 5 showing the positions of the parts when the ram assembly is being pulled from its forward position to its retracted position.

At the beginning of the return stroke, when the ram assembly 12 is pulled by the actuator leftwardly, the lost motion connection between the collar assembly 48 and the second end 80 of the flexible member becomes effective and the pin moves relatively leftwardly of the left hand side of the hole 90. The flexible member 50 is thereby pulled leftwardly and the opposed shoulders or edges 81, 83 on the arms 66 of the flexible member 50 and the edges of the recess 68 function as a coupling between the flexible member 50 and the first collar assembly 46. During this portion of the cycle, the flexible member is placed in tension and extends axially as shown in FIG. 8.

Figure 3:
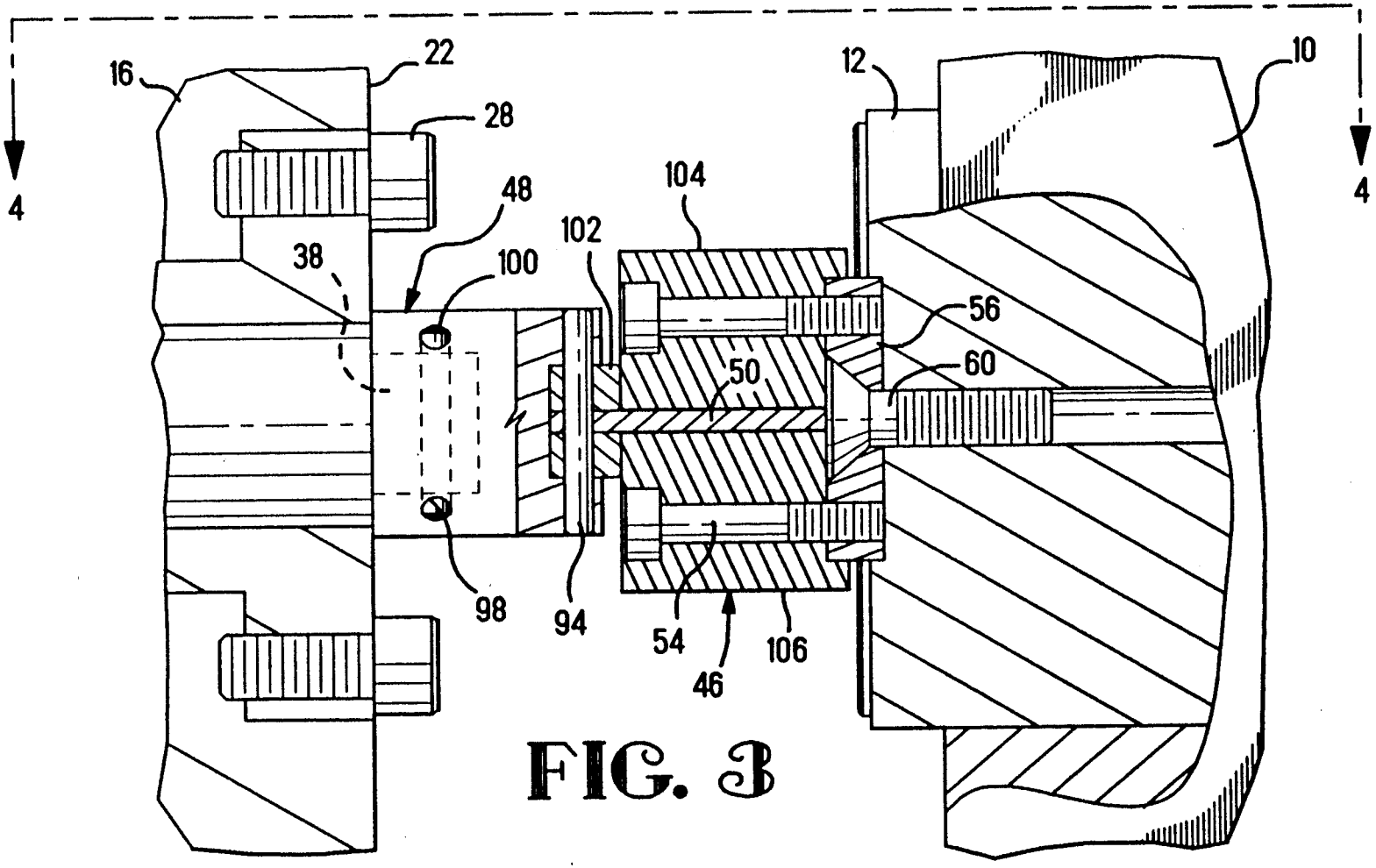
FIG. 3 is a sectional side view on an enlarged scale of the coupling.
Figure 4:
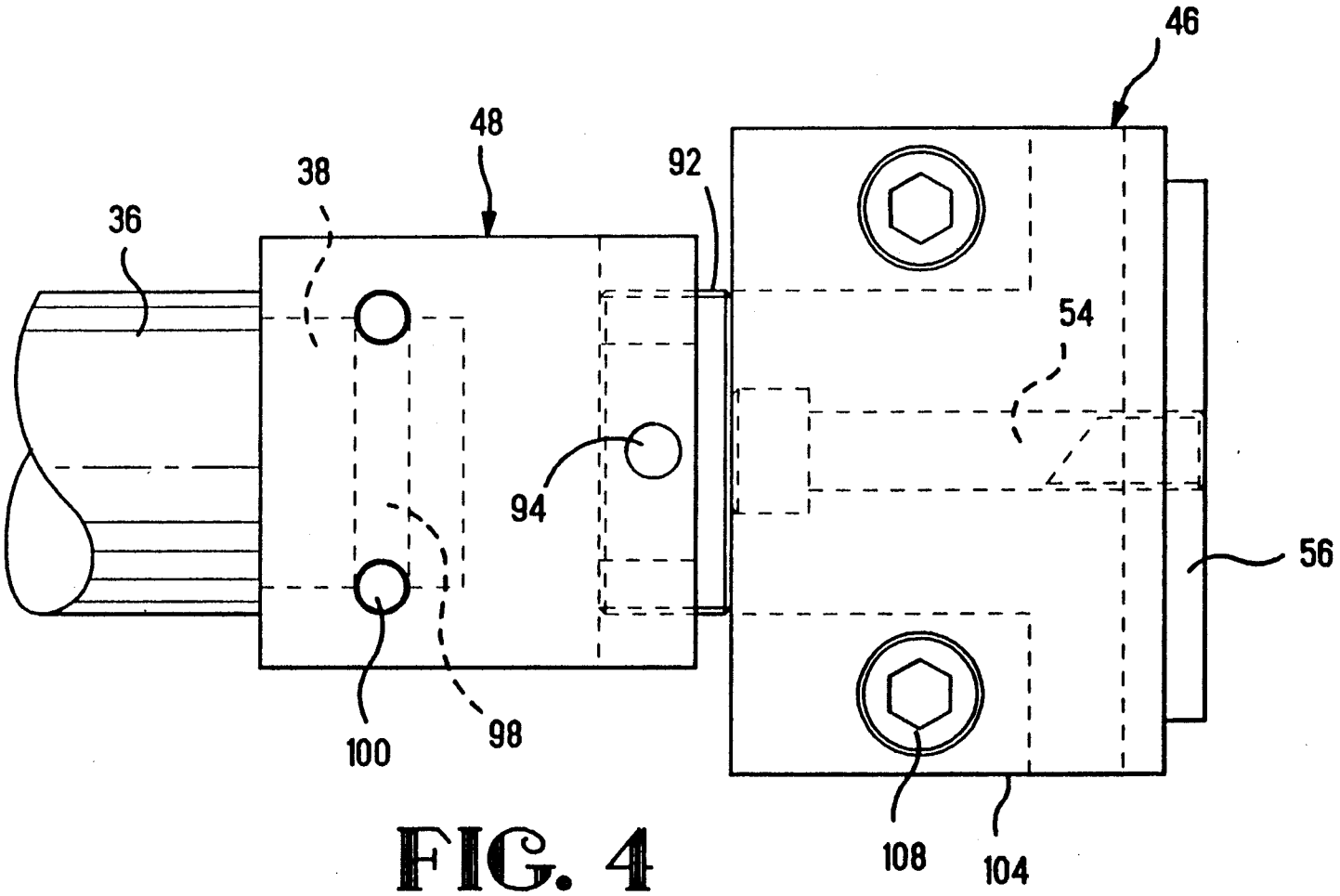
FIG. 4 is a top plan view of the coupling looking in the direction of the arrows 4—4 of FIG. 3.

The actual coupling 46 as shown in FIG. 3 differs in some respects from the diagramatic views of FIGS. 5–8. The second collar assembly 48 is connected to the reduced end portion 38 of the rod 36 by a connection which permits rotation of the rod relative to the collar assembly. The reduced end 38 of the rod is provided with a circumferential groove 98 and coupling pins 100 extend through the collar and are received in this groove. The rod 36 can thus be rotated without affecting the collar assembly 48.

The recess 82 in the collar assembly 48 is relatively wider than the recess shown in FIG. 5 and two spacers or adaptors 102 are contained in the recess on each side of the flexible member. These spacers or adaptors are provided only for purposes of manufacturing convenience.

The first collar assembly 46 is a composite member having upper and lower sections 104, 106 which are secured to each other by fasteners 108. The T-shaped recess 68 in which flexible member 50 is contained is formed by recesses in the opposed surfaces of the two sections 104, 106.

Flexible member has an overall length of about 31 mm and a thickness of about 2.38 mm. This flexible member can be formed with two or more thin stampings, rather than as a single piece, in order to reduce the maximum bending stresses developed when the member is repeatedly flexed and in order to avoid metal fatigue.

The clearances between the flexible member 50 and the collar sections 46, 45 are very small and are greatly exaggerated in FIGS. 5–8 for purposes of explanation. For example, the clearance between the shear pin 94 and the hole 90 in flexible member 50 is only about 0.002 mm. The connection between the second end 80 of flexible member 50 and the second collar section 48 is nonetheless a lost motion connection and the pin is stressed only when the ram assembly 12 is pulled from its forward position to its retracted position. The ram is pushed by the surface 86 when the ram is moved from its retracted position to its forward position, and the pin is not stressed during that portion of the cycle.

Many of the advantages of the invention will be obtained if the ends 65, 80 of flexible member 50 are secured tot he ram and the actuator with rigid connections, however the advantages obtained by the use of the shear pin will not be obtained. Also, the disclosed construction of the coupling is believed to be the best known at present from the standpoint of manufacturing convenience.

One advantage of the invention is that in the event of the development of excessive forces in the coupling 44, as a result of galling or a jam in the tooling, the shear pin will fail and damage to the machine will be avoided. Another advantage is that frictional losses are minimized and little or no lubrication is required.

I claim:

1. A stamping and forming machine comprising a pair of ram assemblies which are movable towards and away from each other along paths of reciprocation between forward and retracted positions, the ram assemblies having stamping tooling on their opposed ends, strip feeding means for feeding strip material along a strip feed path which extends between the ram assemblies, an actuator for each of the ram assemblies, each actuator being movable to-and-fro along an arcuate path, and force transmitting couplings which couple each of the actuators to its associated ram assembly, the machine being characterized in that:

each of the couplings comprises a flexible member which extends between the actuator and the ram assembly, the flexible member having first and second ends, the first end being connected to the ram assembly, the second end being connected to the actuator, the coupling has supporting surfaces which extend beside the flexible member, the supporting surfaces permitting flexure of the flexible member by a limited amount and supporting the flexible member against flexure by an amount greater than the limited amount whereby, during movement of the ram assembly from its retracted position to its forward position, the ram assembly is pushed by the actuator, the flexible member functions as a compression member, and the flexible member is flexed by the limited amount, and during movement of the ram assembly form its forward position to its retracted position, the ram assembly is pulled by the actuator and the flexible member functions as a tension member.

2. A machine as set forth in claim 1 characterized in that the flexible member is contained in a collar assembly which surrounds the flexible member, and the supporting surfaces are on the collar assembly.

3. A machine as set forth in claim 1 characterized in that the second end of the flexible member is connected to the actuator by a connection which will fail in the event of the development of excessive forces when the ram assembly is pulled from its forward position to its retracted position thereby to prevent damage to the machine.

4. A machine as set forth in claim 3 characterized in that the connection between the actuator and the flexible member is a shear pin.

5. A machine as set forth in claim 1 characterized in that the flexible member is a flat plate-like member and the supporting surfaces are flat surfaces which extend parallel to the plate-like member.

6. A machine as set forth in claim 1 characterized in that the ram assembly has a longitudinal axis which is parallel to the path of reciprocation, and the first end of the flexible member is in alignment with the longitudinal axis whereby the force transmitted to the ram assembly when the ram assembly is pushed from its retracted position to its forward position is an axial force.

7. A machine as set forth in claim 6 characterized in that the flexible member is contained in a collar assembly which surrounds the flexible member, and the supporting surfaces are on the collar assembly.

8. A machine as set forth in claim 7 characterized in that the collar assembly comprises first and second collar sections, the first collar section being secured to the ram assembly, the second collar section being secured to the actuator.

9. A machine as set forth in claim 8 characterized in that the first end of the flexible member is secured to the ram assembly by opposed shoulders on the flexible member and the first collar section, and the second end of the flexible member is secured to the actuator by a connection between the flexible member and the second collar section which will fail in the event of the development of excessive forces when the ram assembly is pulled from its forward position to its retracted position thereby to prevent damage to the machine.

10. A machine as set forth in claim 9 characterized in that the second end of the flexible member is secured to the second collar section by a shear pin.

11. A machine as set forth in claim 10 characterized in that the connection between the second end of the flexible and the second collar section is a lost motion connection.

12. A machine as set forth in claim 11 characterized in that the flexible member is a flat plate-like member and the supporting surfaces are on the first collar section.

13. A machine as set forth in claim 12 characterized in that the second collar section has driving surface portions which are adjacent to, and movable against, the second end of the flexible member when the ram assembly is pushed from its retracted position to its forward position.

14. Force transmitting means for transmitting force from an actuator assembly, which moves to-and-fro along an actuator path, to a ram assembly which reciprocates along a rectilinear path between a retracted position and a forward position, the force transmitting means comprising:

a flexible member extending between the actuator assembly and the ram assembly, the flexible member having first and second ends, the first end being against the ram assembly, the second end being proximate to the actuator assembly, the flexible member and the ram assembly are connected to each other by oppositely facing shoulder portions on the ram assembly and the flexible member, the flexible member and the actuator assembly are connected to each other by a lost motion connection, the actuator assembly has actuator driving surface portions which are adjacent to, and movable against, the second end of the flexible member, and supporting surfaces are provided which extend parallel to the flexible member, the supporting surfaces permitting a limited amount of flexure of the flexible member and preventing flexure by an amount greater than the limited amount whereby, when the actuator assembly moves in one direction along its actuator path the actuator driving portions move against the second end of the flexible member, the flexible member is placed in compression, and first end of the flexible member pushes the ram assembly from its retracted position to its forward position, the flexible member being flexed by a limited amount and being supported after it is flexed, and when the actuator moves in the opposite direction, the flexible member is placed in tension and the ram assembly is pulled to its retracted position.

15. Force transmitting means as set forth in claim 14 characterized in that the actuator path is an arcuate path.

16. Force transmitting means as set forth in claim 14 characterized in that the actuator assembly and the second end of the flexible member have overlapping portions and have aligned openings in the overlapping portions, the lost motion connection comprises a pin which extends through the aligned openings.

17. Force transmitting means as set forth in claim 14 characterized in that the lost motion connection connects the flexible member to the actuator assembly when the ram assembly is pulled from its forward position to its retracted position and does not connect the actuator assembly to the flexible member when the ram assembly is pushed from its retracted position to its forward position.

18. Force transmitting means as set forth in claim 16 characterized in that the pin is a shear pin which fails in shear in the event of the development of excessive pulling force when the actuator assembly pulls the ram assembly from its forward position to its retracted position.

19. Force transmitting means as set forth in claim 14 characterized in that the ram assembly has a longitudinal ram axis which is parallel to the path of reciprocation, and the flexible member is a plate-like member having a longitudinal axis which is in alignment with the longitudinal ram axis.

20. Force transmitting means as set forth in claim 19 characterized in that the ram assembly comprises a ram block and a first collar assembly which is secured to the ram block, the supporting surfaces being on the first collar assembly.

* * * * *